US006265985B1

(12) United States Patent
Nieberger

(10) Patent No.: US 6,265,985 B1
(45) Date of Patent: Jul. 24, 2001

(54) METHOD AND APPARATUS FOR CONTROLLING TWO DEPENDENT VISUAL INDICATORS WITH A SINGLE OUTPUT PIN

(75) Inventor: Mathew Arthur Nieberger, Rocklin, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/516,833

(22) Filed: Mar. 1, 2000

(51) Int. Cl.[7] ..... G08B 5/22

(52) U.S. Cl. ..... 340/815.45; 340/691.1; 340/691.4

(58) Field of Search ..... 340/815.45, 815.44, 340/691.1, 691.4, 691.6

(56) References Cited

U.S. PATENT DOCUMENTS 4,924,177 * 5/1990 Mulz ..... 324/133
5,359,290 * 10/1994 Cervas ..... 324/384
6,037,874 * 3/2000 Heironimus ..... 340/686.1

* cited by examiner

*Primary Examiner*—Jeffrey Hofsass
*Assistant Examiner*—Phung T Nguyen

(57) ABSTRACT

An apparatus for controlling the illumination of two diode indicator lights with a single control line. The apparatus includes a circuit adapted to selectively provide one of high, low and medium voltage levels on a control output line responsive to combinations of high and low DATA and ENABLE signals. A first indicator is provided having a first diode with an anode and a cathode, the cathode being operatively connected to ground. A second indicator is provided having a second diode with an anode and a cathode, the cathode being operatively connected to a source of medium level voltage. A current limiting resistor is provided having a first end operatively connected to the anode of each of the first and second diodes, the opposite end thereof being connected to the control output line. Moreover, a pull-up resistor is provided having one end connected to the control output line and an opposite end connected to the medium level voltage source. The first diode indicator is switched on when the output line voltage level is medium, both of the first and second diode indicators are switched on when the voltage level is high and neither of the diode indicators are switched on when the voltage level is low.

14 Claims, 1 Drawing Sheet

METHOD AND APPARATUS FOR CONTROLLING TWO DEPENDENT VISUAL INDICATORS WITH A SINGLE OUTPUT PIN

FIELD OF THE INVENTION

The present invention relates generally to a display apparatus, and more particularly to an apparatus for controlling two visual indicators with a single output pin of an integrated circuit, an illumination condition of one the visual indicators being dependent on an illumination condition of the other visual indicator.

BACKGROUND OF THE INVENTION

In a conventional display apparatus including two independent visual indicators, each indicator is independently driven using separate integrated circuit pins and separate current limiting resistors. This type of conventional display apparatus is problematic in that it is "pin constrained". In other words, an excessively large number of integrated circuit pins are required to drive a large scale display apparatus. Notably each additional pin in an application specific integrated circuit has a tangible cost associated with it. In other words, each additional pin required to drive the visual indicators eliminates other possible functions or forces the use of a larger and more expensive integrated circuit package.

Moreover, conventional display apparatus require that a separate current limiting resistor be provided for each independently driven visual indicator. This is problematic in that it increases the scale of the display apparatus.

Accordingly, a primary object of the present invention is to provide an improved display apparatus in which a only single integrated circuit output pin is needed to selectively drive two dependent visual indicators.

Another object of the present invention is to provide such an improved display apparatus in which a single current limiting resistor is used to drive two independent visual indicators, thereby reducing the size of the display apparatus relative to many conventional display apparatus.

BRIEF DESCRIPTION OF THE DRAWINGS

These and other objects of the invention will be apparent from the following detailed description in connection with the attached drawings, in which.

SUMMARY OF THE INVENTION

Broadly stated, the display apparatus of the present invention includes a pair of indicator lights that are adapted to be selectively turned on and off with a signal level applied on a single line. The ability to control the operation of two indicator lights with a single line minimizes the number of output pins that are used from an electronic integrated circuit compared to many prior art configurations. Moreover, only a single current limiting resistor is needed for two indicator lights which reduces the size of the display apparatus compared to some prior art configurations.

DETAILED DESCRIPTION OF THE INVENTION

Figure 1:
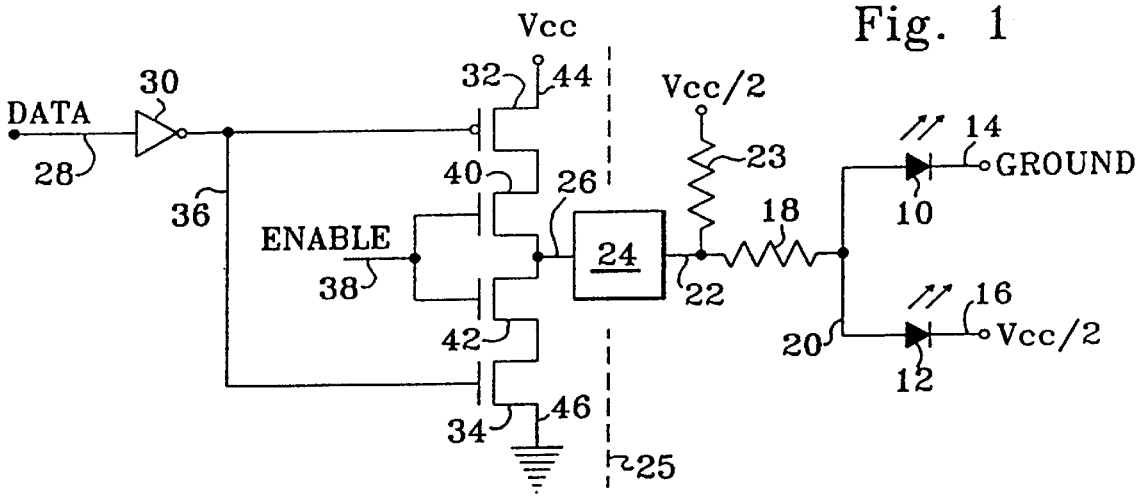
FIG. 1 is a schematic circuit diagram of a display device embodying the present invention.

A circuit diagram of the preferred embodiment of the improved display device of the present invention is shown in FIG. 1 and includes a pair of visual indicators which are preferably light emitting diodes (LEDs) 10 and 12 that are connected in parallel with the anode of LED 10 connected to line 20 which is connected to the anode of LED 12. The cathode of LED 10 is connected to ground via line 14, and the cathode of LED 12 is connected to a source of voltage Vcc/2 via line 16.

A single current limiting resistor 18 is connected at one end to the line 20, and is connected at another end to an IC pad 24 via line 22. The IC pad 20 is preferably a standard output buffer having three output states, which are identified as Drive-High, Drive-Low and Drive-Disable. The output states are preferably approximately at the level of Vcc, Vcc/2 and ground.

A pull-up resistor 23 is connected at one end to the line 22, and is connected at another end to a source of voltage Vcc/2.

Figure 2:
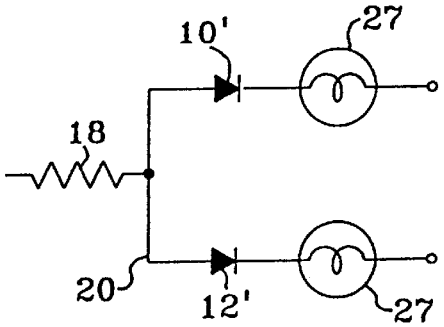
FIG. 2 is an alternative embodiment of a portion of the circuit diagram shown in FIG. 1; and, FIG. 3 is a schematic circuit diagram of an alternative embodiment of the present invention.

The portion of the circuitry comprising components 10 through 23 are preferably located externally of the portion of the circuitry shown to the left of the line 25. The LEDs 10 and 12 may be separately formed, or may be provided in a single unitary package. However, one of ordinary skill in the art understands that the indicator lights may be formed of a standard diode 10' or 12' connected in series with a lamp 27 as shown in FIG. 2.

In accordance with an important aspect of the present invention, the two LEDs 10 and 12 can be dependently controlled by a signal on a single control line 26 that is provided by circuitry indicated to the left of dotted line 25. The circuitry shown is representative of the logic that used in the present invention, and it can be carried out in a microprocessor or other processor or processing integrated circuit, such as an ASIC, for example. It should be understood that such a microprocessor or other device may perform substantial functionality and the visual indicator control represents a very minor part of its overall operation. Because of the many control functions that the microprocessor may carry out, the number of output pins that exist for controlling visual indicator operation may be quite limited, and for that reason, the present invention has a marked advantage over many prior art designs because the present invention can independently and selectively control two visual indicators with a single output pin.

The improved display device of the present invention may be used in any application requiring the dependent control of two indicator lights. However, according to a preferred embodiment, the improved display device is incorporated in a print server.

Referring to the left portion of FIG. 1, a DATA signal is applied on line 28 that is connected to an inverter 30 which in turn is connected to transistors 32 and 34 via line 36. Transistor 32 has an inverting input while transistor 34 does not. This results in a high DATA signal switching transistor 32 into conduction and switching transistor 34 off, and a low DATA signal doing the opposite. An ENABLE signal is applied to line 38 that extends to transistors 40 and 42 both of which are connected to control line 26. As shown, transistor 40 is connected to transistor 32, and transistor 42 is connector to transistor 34. Transistor 32 is connected to a voltage source Vcc via line 44 and transistor 34 is connected to ground via line 46. The transistors shown in FIG. 1 are illustrated to be CMOS transistors, but it should be understood that other types of transistors or other configurations of logic elements could be used to carry out the operation of the present invention, i.e., to provide the signals on control line 26 that will be hereinafter described.

The operation of the circuitry shown in FIG. 1 can be understood from the state table shown below in Table 1.

TABLE 1

| DATA | ENABLE | D10 | D12 | PAD STATE |
|---|---|---|---|---|
| "don't care" | LOW | ON | OFF | Disable-Drive |
| LOW | HIGH | OFF | OFF | Drive-LOW |
| HIGH | HIGH | ON | ON | Drive-HI |

When the ENABLE signal on line 38 is low, transistors 40 and 42 are switched to an off state, and only LED 10 is illuminated (forwardly biased) regardless of the level of the DATA signal on line 28. Thus, a DATA "don't care" condition occurs when the ENABLE signal is low.

When the ENABLE signal on line 38 is high, transistors 40 and 42 are switched to an on state, and a both LEDs 10 and 12 are illuminated depending on the state of the DATA signal on line 28. Thus, for the remaining state conditions in Table 1, the ENABLE signal is high.

When the DATA signal 28 is low, transistor 34 is switched into conduction and current flows through transistors 42 and 34 to ground. This places IC pad 20 at its low output level and line 22 will preferably be approximately at ground. Consequently, neither LED 10 nor LED 12 will illuminate because the voltage Vcc/2 will flow through the pull-up resistor 23 to ground.

Similarly, when the DATA signal is high (and ENABLE signal is high), transistor 32 is switched into conduction (and transistor 34 is switched off) so that current flows from the Vcc source via line 44 through transistors 34 and 40 thereby placing control line 26 to a high level of Vcc minus any parasitic resistance. This causes the IC Pad 20 to provide a high level on line 22 which forward biases LEDs 10 and 12 into conduction. This occurs because the voltage Vcc on line 22 is greater than the ground on line 14 and is greater than voltage Vcc/2 on line 16.

It should be appreciated that the state of LED 12 is dependent on the state of LED 10 in that LED 12 is never illuminated unless LED 10 is also illuminated.

Figure 3:
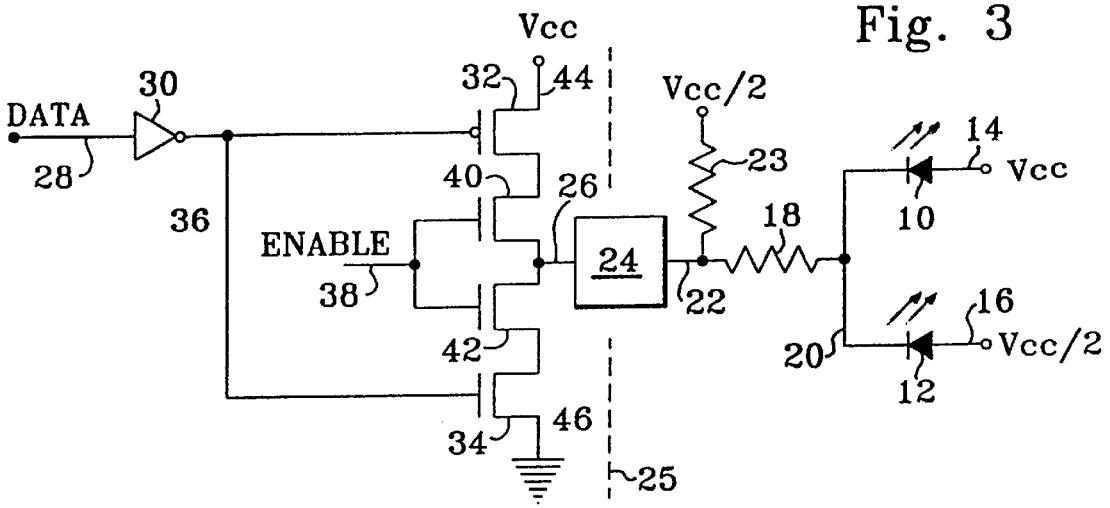

An alternative embodiment to the display device of FIG. 1 is shown in FIG. 3, with like reference numerals being used to identify like parts. The embodiment shown in FIG. 3 is similar to the embodiment shown in FIG. 1, with the following exceptions. In FIG. 3, the orientation of the LED's 10 and 12 are reversed, relative to the embodiment shown in FIG. 1, such that the cathode of LED 10 is connected to the cathode of LED 12 via the line 20. Moreover, in FIG. 3, the anode of LED 10 is connected to a source of voltage Vcc via line 14, and the anode of LED 12 is connected to a source of voltage Vcc/2 via line 16.

The operation of the circuitry shown in FIG. 3 can be understood from the state table shown below in Table 2.

TABLE 2

| DATA | ENABLE | D10 | D12 | PAD STATE |
|---|---|---|---|---|
| "don't care" | LOW | ON | OFF | Disable-Drive |
| LOW | HIGH | ON | ON | Drive-LOW |
| HIGH | HIGH | OFF | OFF | Drive-HI |

When the ENABLE signal on line 38 is low, transistors 40 and 42 are switched to an off state, and only LED 10 is illuminated (forwardly biased) regardless of the level of the DATA signal on line 28. Thus, a DATA "don't care" condition occurs when the ENABLE signal is low.

When the ENABLE signal on line 38 is high, transistors 40 and 42 are switched to an on state, and a both LEDs 10 and 12 are illuminated depending on the state of the DATA signal on line 28. Thus, for the remaining state conditions in Table 1, the ENABLE signal is high.

When the DATA signal 28 is low, transistor 34 is switched into conduction and current flows through transistors 42 and 34 to ground. This places IC pad 20 at its low output level and line 22 will preferably be approximately at ground. Consequently, neither LED 10 nor LED 12 will illuminate because the voltage Vcc/2 will flow through the pull-up resistor 23 to ground.

Similarly, when the DATA signal is high (and ENABLE signal is high), transistor 32 is switched into conduction (and transistor 34 is switched off) so that current flows from the Vcc source via line 44 through transistors 34 and 40 thereby placing control line 26 to a high level of Vcc minus any parasitic resistance. This causes the IC Pad 20 to provide a high level on line 22 which forward biases LEDs 10 and 12 into conduction. This occurs because the voltage Vcc on line 22 is greater than the ground on line 14 and is greater than voltage Vcc/2 on line 16.

It should be appreciated that the state of LED 12 is dependent on the state of LED 10 in that LED 12 is never illuminated unless LED 10 is also illuminated.

From the foregoing, it should be appreciated that an improved display apparatus has been shown and described which offers many advantages and desirable attributes compared to prior art display devices. The present invention conserves utilization of precious output pins of integrated circuits, in that it can selectively control two visual displays with a single output pin. The circuit design of the present invention is compact in size, and elegant in its simplicity and operation.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for controlling the illumination of two diode indicator lights with a single control line, said apparatus comprising:

circuit means adapted to selectively provide one of high, low and medium voltage levels on a control output line responsive to combinations of high and low DATA and ENABLE signals;

a first indicator means having a first diode with an anode and a cathode, said cathode being operatively connected to ground;

a second indicator means having a second diode with an anode and a cathode, said cathode being operatively connected to a source of medium level voltage;

a current limiting resistor having a first end operatively connected to said anode of each of said first and second diodes, the opposite end thereof being connected to said control output line; and, a pull-up resistor having one end connected to said control output line and an opposite end connected to said medium level voltage source;

said first diode indicator means being switched on when said output line voltage level is medium, both of said first and second diode indicator means being switched on when said voltage level is high and neither of said diode indicator means being switched on when said voltage level is low.

2. Apparatus as defined in claim 1 wherein each of said first and second diode indicator means comprises a light emitting diode.

3. Apparatus as defined in claim 1 wherein each of said first and second diode indicator means comprises a diode and a lamp connected in series.

4. Apparatus as defined in claim 2 wherein said first and second LEDs are contained in a common package.

5. Apparatus as defined in claim 1 wherein said circuit means further comprises an output buffer with the output buffer providing said control output line.

6. Apparatus for controlling the illumination of two diode indicator lights with a single control line, said apparatus comprising:

circuit means adapted to selectively provide one of high, low and medium voltage levels on a control output line responsive to combinations of high and low DATA and ENABLE signals;

a first light emitting diode (LED) having an anode and a cathode, said cathode being operatively connected to ground;

a second LED having an anode and a cathode, said cathode being operatively connected to a source of medium level voltage;

a current limiting resistor having a first end operatively connected to said anode of each of said first and second LEDs, the opposite end thereof being connected to said control output line; and, a pull-up resistor having one end connected to said control output line and an opposite end connected to said medium level voltage source;

said first LED being switched on when said output line voltage level is medium, both of said first and second LEDs being switched on when said voltage level is high and neither of said LEDs being switched on when said voltage level is low.

7. Apparatus as defined in claim 6 wherein said circuit means further comprises an output buffer with the output buffer providing said control output line.

8. Apparatus for controlling the illumination of two diode indicator lights with a single control line, said apparatus comprising:

circuit means adapted to selectively provide one of high, low and medium voltage levels on a control output line responsive to combinations of high and low DATA and ENABLE signals;

a first indicator means having a first diode with an anode and a cathode, said anode being operatively connected to a source of high level voltage;

a second indicator means having a second diode with an anode and a cathode, said anode being operatively connected to a source of medium level voltage;

a current limiting resistor having a first end operatively connected to said cathode of each of said first and second diodes, the opposite end thereof being connected to said control output line; and, a pull-up resistor having one end connected to said control output line and an opposite end connected to said medium level voltage source;

said first diode indicator means being switched on when said output line voltage level is medium, both of said first and second diode indicator means being switched on when said voltage level is low and neither of said diode indicator means being switched on when said voltage level is high.

9. Apparatus as defined in claim 8 wherein each of said first and second diode indicator means comprises a light emitting diode.

10. Apparatus as defined in claim 8 wherein each of said first and second diode indicator means comprises a diode and a lamp connected in series.

11. Apparatus as defined in claim 9 wherein said first and second LEDs are contained in a common package.

12. Apparatus as defined in claim 8 wherein said circuit means further comprises an output buffer with the output buffer providing said control output line.

13. Apparatus for controlling the illumination of two diode indicator lights with a single control line, said apparatus comprising:

circuit means adapted to selectively provide one of high, low and medium voltage levels on a control output line responsive to combinations of high and low DATA and ENABLE signals;

a first light emitting diode (LED) having an anode and a cathode, said anode being operatively connected to a source of high level voltage;

a second LED having an anode and a cathode, said anode being operatively connected to a source of medium level voltage;

a current limiting resistor having a first end operatively connected to said cathode of each of said first and second LEDs, the opposite end thereof being connected to said control output line; and, a pull-up resistor having one end connected to said control output line and an opposite end connected to said medium level voltage source;

said first LED being switched on when said output line voltage level is medium, both of said first and second LEDs being switched on when said voltage level is low and neither of said LEDs being switched on when said voltage level is high.

14. Apparatus as defined in claim 13 wherein said circuit means further comprises an output buffer with the output buffer providing said control output line.

* * * * *